United States Patent [19]

Peters et al.

[11] 4,346,577

[45] Aug. 31, 1982

[54] METHOD FOR PRODUCING CURVED VALVE NEEDLES

[75] Inventors: Klaus-Jürgen Peters, Affalterbach; Rudolf Krauss, Stuttgart; Ernst Binggeser, Asperg, all of Fed. Rep. of Germany

[73] Assignee: Robert Bosch GmbH, Stuttgart, Fed. Rep. of Germany

[21] Appl. No.: 170,224

[22] Filed: Jul. 18, 1980

[30] Foreign Application Priority Data

Aug. 24, 1979 [DE] Fed. Rep. of Germany ..... 2934217

[51] Int. Cl.[3] ..... B24B 19/16; F02M 69/00; B21F 3/04

[52] U.S. Cl. ..... 72/129; 72/340; 29/157.1 R; 51/281 R; 51/324

[58] Field of Search ..... 51/281 R, 5 A, 5 B, 51/54, 105 VG, 324, 129; 163/1, 5; 72/129, 130, 340, 131; 261/DIG. 38; 251/DIG. 4; 29/157.1 R, 157.1 A

[56] References Cited

U.S. PATENT DOCUMENTS

| | | | |
|---|---|---|---|
| 2,043,695 | 6/1936 | Brownlee | 51/281 R |
| 2,242,180 | 5/1941 | Jepson | 72/340 |
| 2,623,550 | 12/1952 | Artoni | 72/129 |
| 2,697,865 | 12/1954 | Norton | 72/340 |
| 2,924,826 | 2/1960 | Koppinger | 72/131 |
| 2,948,954 | 8/1960 | Ramsa | 72/129 |
| 4,221,747 | 9/1980 | Edmonston | 261/DIG. 38 |

*Primary Examiner*—James M. Meister
*Assistant Examiner*—Robert A. Rose
*Attorney, Agent, or Firm*—Edwin E. Greigg

[57] ABSTRACT

A method is proposed which serves to produce a valve needle of a needle valve. The basis of the method is the production, from a wire serving as the raw material, of a springlike coil on a carrier body, where the adjacent courses of the coil rest on one another, and this coil applied to the carrier body is provided on its circumference with a predetermined contour by grinding on a grinding machine. After the grinding, the individual courses of the coil, forming the individual valve needles, are separated. The wire serving as the raw material and the valve needles after separation of the courses of the coil can be subjected in a suitable manner to a heat treatment. In a simple and inexpensive manner, the method assures the production of curved valve needles with precise dimensions.

7 Claims, 7 Drawing Figures

FIG.3
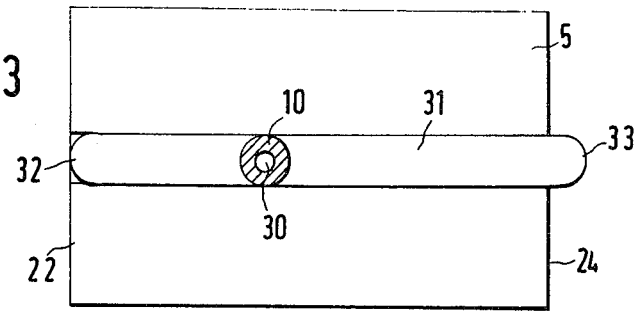
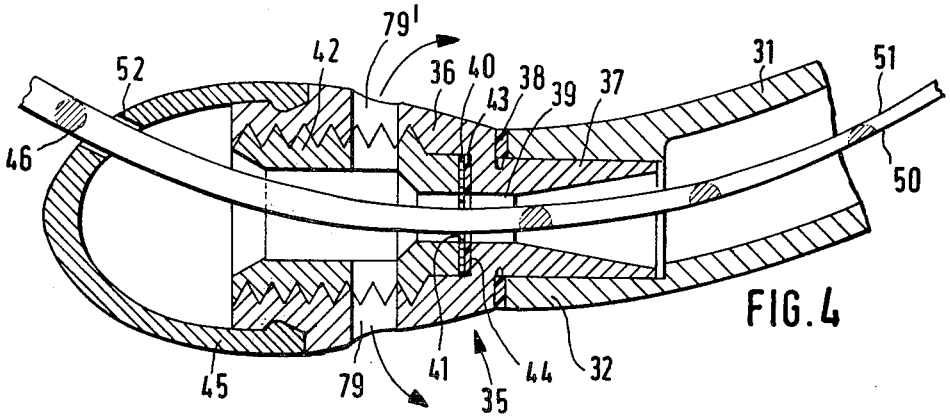
FIG.4
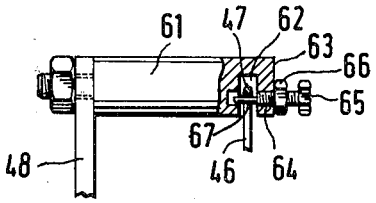
FIG.5
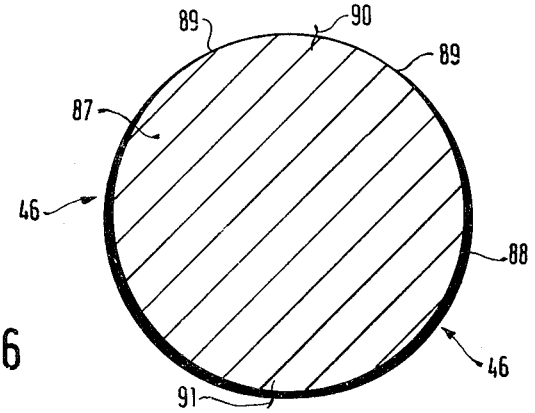
FIG. 6

METHOD FOR PRODUCING CURVED VALVE NEEDLES

BACKGROUND OF THE INVENTION

The invention relates to a method for producing a curved valve needle. A method is already known for producing conically embodied needles of needle valves. Such methods are not suitable, however, for producing curved valve needles.

OBJECT AND SUMMARY OF THE INVENTION

The method according to the invention having the characteristics set forth herein has the advantage over the prior art that it assures the production of curved valve needles in a simple, precise, and inexpensive manner.

Through application of the characteristics set forth herein, further advantageous modifications of and improvements to the method disclosed in the main claim are possible.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 3 is a section taken along the line 111—III of FIG. 2;

FIG. 4 shows a metering valve embodied as a needle valve in a section taken along the line IV—IV in FIG. 1;

FIG. 5 shows a manner of supporting a valve needle of a metering valve;

FIG. 6 is a side view of a carrier body with a wire coil; and

DESCRIPTION OF THE PREFERRED EMBODIMENT

Figure 1:
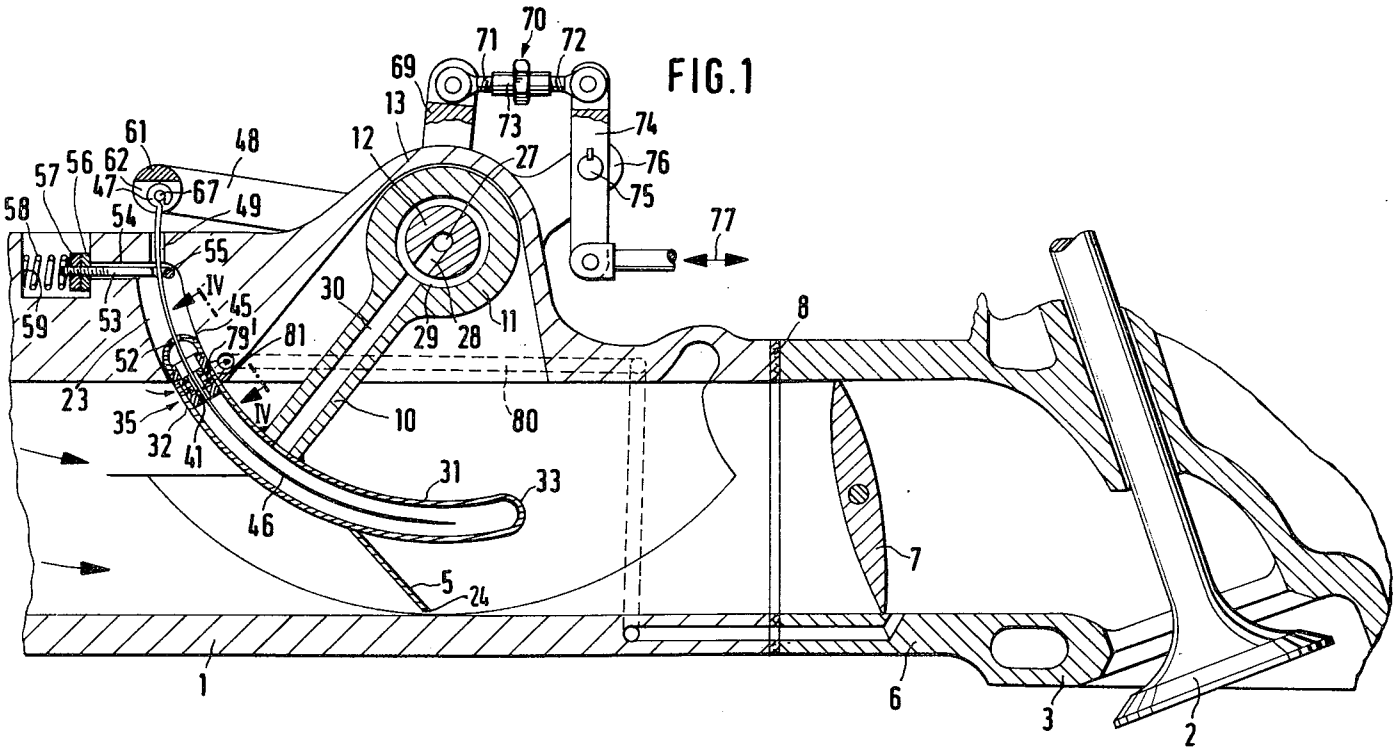
FIG. 1 shows an apparatus in the idling position intended for producing the operational mixture of an internal combustion engine having a metering valve embodied as a needle valve.

In the apparatus shown in FIG. 1 for producing an operational mixture, the air required for combustion flows in the direction of the arrow into an air intake section 1, in particular of an individual intake tube directly upstream of an inlet valve 2, that is, downstream of an air intake manifold, not shown, of an internal combustion engine having one or more cylinders 3, in particular a mixture-compressing engine with externally-supplied ignition. Disposed in the intake tube section 1 is an air flow rate metering device embodied by an air flow rate meter 5 and which, in its outset position, blocks the air intake section 1. A throttle valve 7, which is embodied in as streamlined a fashion as possible, is disposed downstream of the air flow rate meter 5 in an air intake section 6 in communication with the cylinder 3. An oscillation damping member 8 is provided between the air intake sections 1 and 6. The air flow rate meter 5, which is embodied with walls as thin as possible, is embodied as rectangular, as shown in FIG. 3, and is secured to a connecting bar 10, which has a hub 11 on the other side by way of which it is connected to a pivoting shaft 12. The pivoting shaft 12 is supported rotatably in a housing portion 13 and extends transversely to the air flow direction. The air flow rate meter 5 represents a control body which opens the intake tube cross section to a greater or lesser extent depending on the air flow to the cylinders 3 of the engine and which essentially represents a plane lying outside the pivoting shaft 12. The pivotal movement of the air flow rate meter 5 about the pivoting shaft 12 occurs counter to a restoring force, not shown, which is provided by way of example by two restoring springs disposed parallel to one another.

One end 22 of the air flow rate meter 5, in the outset position of the air flow rate meter, protrudes into an indentation 23 of the intake tube wall 1 and thus blocks the intake tube cross section at this end, while the other end 24 of the air flow rate meter 5 rests on the opposite intake tube wall. When the quantity of flowing air is small, during idling operation of the engine, the air flow rate meter 5 pivots about the pivoting shaft 12 into a position in which the end 22 pointing in the direction opposite to that of the air flow continues to remain in the indentation 23, so that no air can pass by this end 22, while at the end 24 of the air flow rate meter 5, a flow cross section is opened. The air flow rate meter functions in this range according to the principle of baffle-type resistance to air flow. With an increasing air quantity, the air flow rate meter 5 pivots with its end 22 out of the indentation 23, so that a further flowthrough cross section is opened at the end 22, and the air flow rate meter has air flowing past it at both ends. Now the air flow rate meter functions according to the air foil principle, and larger adjustment forces are available, especially in the vicinity of the full-load range, for displacing the air flow rate meter 5.

The supply of fuel in this apparatus is effected via a fuel supply line, not shown, which communicates in a manner which is again not shown with the compression side of a fuel supply pump. The fuel supply line discharges into a fuel channel 27 extending axially in the pivoting shaft 12. The fuel channel 27 communicates via a tap line 28 with an annular groove 29 in the hub 11 of the connecting bar 10. A fuel channel 30 is likewise provided in the connecting bar 10 and leads from the annular groove 29 to a circularly curved sheath 31, which is preferably disposed in the middle area of the air flow rate meter 5 in such a manner and communicates with the air flow rate meter 5 and the connecting bar 10 in such a manner that its end 32 pointing in the direction opposite to that of the flow coincides in the spatial disposition with the end 22 of the air flow rate meter 5, so that this end 32 of the sheath 31 protrudes into the indentation 23 in the outset position of the air flow rate meter 5 and the idling position, while in the full-load position of the air flow rate meter 5 it is located approximately in the middle of the flow cross section. The end 33 of the sheath 31 pointing in the flow direction is closed.

A fuel metering valve 35 is disposed on the end 32 of the sheath 31 and thus on the end 22 of the air flow rate valve 5 pointing opposite to the flow direction, and this valve 35 is shown on its own in FIG. 4 on an enlarged scale. A reception body 36 having an extension 37 is inserted into the end 32 of the sheath 31 and secured. A sealing element 38 on the end face of the sheath end 32 prevents the escape of fuel via the extension 37 out of the interior of the sheath 3. The reception body 36 is provided with an axial passageway or bore 39, the cross section of which at its narrowest point is defined by a metering opening 41 provided in a shield body 40. The shield body 40, in disc-like form, is manufactured from material which is as thin as possible and is pressed by a securing element 42, such as a headless screw, with an interposed sealing element 43, against a stop 44 of the bore 39. A cap 45 having the most favorable possible effect on the air flow is disposed on the end of the reception body 36 remote from the sheath 31.

The fuel metering valve 35 is embodied as a needle valve having a metering needle 46 cooperating with the metering opening 41. The metering needle 46 is embodied in the form of a loop at its one end 47 and is attached to the housing, on a bearing lever 48, which is located outside the housing 13 and supported on its other end, for example, on the pivoting shaft 12 but is rotatable relative thereto. The air flow rate meter 5 is guided by the connecting bar 10 in such a manner that the plane which it determines extends substantially outside the pivoting shaft 12. The metering needle 46 protrudes through an opening 49 in the housing wall 13 into the indentation 23 and is circularly curved in such a manner that upon a pivoting movement on the part of the air flow rate meter 5, and engaging an opening 52 in the cap 45, it opens the metering opening 41, through which the metering needle 46 protrudes and which is provided in the shield body 40, to a greater or lesser extent. The metering needle 46 is manufactured of material having a circular cross section and has a metering area 89, in which more or less material is removed only on the circumferential side 50 of the metering needle 46 representing the larger circular arc--that is, the side 50 remote from the connecting bar 10, as is shown in the cross-sectional views of the metering needle 46 according to FIG. 4. In order to prevent a displacement in position of the metering needle 46 relative to the metering opening 41 from causing different metering quantities, the metering needle 46 should be guided in such a manner that on its circumferential side 51 representing the smaller circular arc and oriented toward the connecting bar 10 it rests against the metering opening 41. The position of the metering needle 46 relative to the metering opening 41 can be influenced first by means of an actuation member 53, which is disposed in a housing bore 54 and grippingly surrounds the metering needle 46 with a hook-like end 55. The actuation member 53 is displaceable within the housing bore 54 and has a thread on its end remote from the hook-like end 55 onto which an adjusting nut 56 and a lock nut 57 are threaded. A compression spring 58 is supported on the lock nut 57 and is supported on the other end, attached to the housing, on a stop 59 of the housing 13. The metering needle 46 can thus be deflected in the axial direction counter to the force of the compression spring 58.

FIG. 5 shows solely the suspension of the metering needle 46 via its loop 47 on the bearing lever 48, in a side view. A shaft 61 is connected with the bearing lever 48 and has a recess 62 transverse to the longitudinal axis of the bolt. Parallel to the longitudinal axis of the bolt, a threaded bore 64 is provided, which extends from the side face 63 of the shaft 61 toward the recess 62, into which a screw 65 with a lock nut 66 is threaded. On the end of the screw 65 oriented toward the recess 62, a suspension pin 67 which extends eccentrically with respect to the screw axis is connected with the screw body; the suspension pin 67 extends transversely to the recess 62 and the loop-like end 47 of the metering needle 46 is suspended on this suspension pin 67. Rotation of the screw 65 thus enables a vertical displacement of the metering needle 46 relative to the metering opening 41.

The bearing lever 48 can be connected with an actuation lever 69, on which a so-called tension lock or turnbuckle 70 is pivotably supported, embodied by two threaded pins 71, 72 having threads running in opposite directions and a threaded sheath 73 connecting the two threaded pins 71, 72. On the other end, the tension lock 70 engages a pivot lever 74, which is connected in a twist-free manner with a rotary shaft 75 supported on support points 76 attached to the housing. By twisting the threaded sheath 73 of the tension lock 70, the position of the metering needle 46 relative to the metering opening 41 can be varied in a precise manner. An intervention can be made at the pivot lever 74, either arbitrarily or in accordance with operational variables of the engine such as temperature, pressure, or exhaust gas composition, in the direction of the arrow 77 in order to vary the fuel-air mixture.

Directly downstream of the metering opening 41, at least one radial nozzle opening 79, 79' is provided, which beginning at the passageway bore 39 passes through the securing element 42 and the reception body 36 and by way of which the metered fuel can be injected. The fuel exiting at the nozzle openings 79, 79' can be carried away immediately in the direction of the arrow by the air flowing at a high flow velocity and thus finely distributed. In FIG. 1, the air flow rate meter 5 is shown in its idling position in which at least one of the nozzle openings 79' is covered by the indentation 23, while the other nozzle opening or openings 79 is or are exposed to the air flow.

It has proved to be efficient for the idling mixture quantity to be injected via a separate idling mixture channel 80, which is provided in the housing 13 and the intake tube walls 1, 6 and which discharges back into the intake tube section 6 downstream from the throttle valve 7. To this end, a funnel-like collector channel 81 is provided in the region of the indentation 23, in which the one nozzle opening 79' is located in the idling position of the air flow rate meter 5. On the other end, the collector channel 81 discharges into the idling channel 80. The air flowing into the intake tube section 1 in the direction of the arrow likewise flows, as indicated by the arrow, via at least one nozzle opening 79 which is opened toward the intake tube in the idling position of the air flow rate meter 5 and so carries the idling fuel, metered at the fuel metering valve 35, along with it via the nozzle opening 79' into the collector channel 81 and from thence, in turn, on into the idling channel 80.

Figure 2:
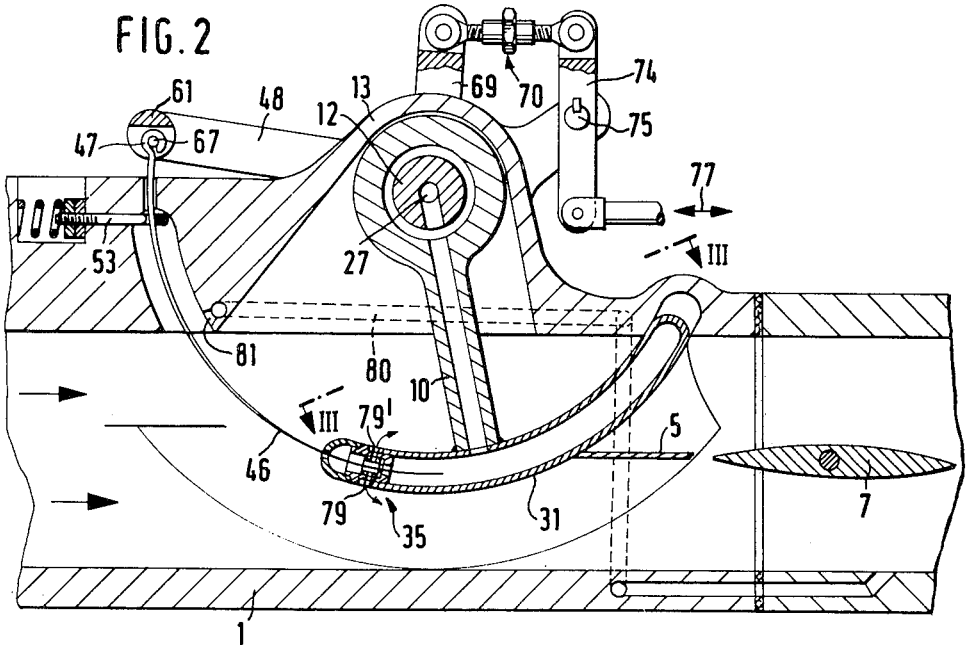
FIG. 2 shows an apparatus in the full-load position for producing the operational mixture of an internal combustion engine having a metering valve embodied as a needle valve.

In FIG. 2, the air flow rate meter 5 is shown in its full-load position in which the fuel metering valve 35 and thus the nozzle openings 79 and 79' are located approximately in the middle of the intake tube, that is, in a region of maximum air velocity and maximum distance away from the walls of the intake tube. As a result, fuel deposit onto the walls of the intake tube is to the greatest possible extent avoided. The very large adjustment path of the fuel metering valve 35 between the idling position and the full-load position produces very good dissolution capacity on the part of the fuel metering valve 35 and results in very good adaptability to the various operational ranges of the engine.

Although it is not shown, an apparatus for producing an operational mixture can be provided in each individual intake tube 1, 6 directly upstream of the inlet valve 2 of each cylinder 3 of the engine, upstream of each throttle valve 7, each apparatus having one air flow rate meter 5 and an associated fuel metering valve 35.

As a result of the fixed coupling of each air flow rate meter 5 with the common pivoting shaft 12, all the air flow rate meters 5 which may be present are in the same position; that is, the same total air quantity flowing to the cylinders of the engine is always metered. The throttle valves 7 disposed directly upstream of each inlet valve 2 are likewise disposed on a common throttle valve shaft and are adjustable in common by a gas pedal, not shown, for instance that in a motor vehicle. In the same manner, the pivot levers 74 of the individual apparatuses are supported in a twist-free manner on the rotary shaft 75, so that a twisting of the rotary shaft 75 simultaneously causes a pivoting of all the metering needles 46 in order to influence the fuel-air mixture.

Figure 7:
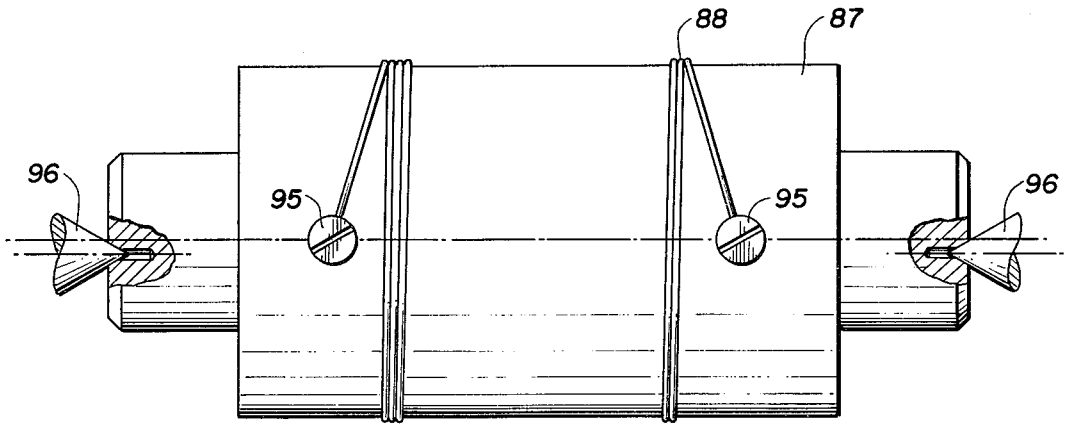
FIG. 7 illustrates the wire secured to a mandrel prepared for grinding.

As shown in FIGS. 6 and 7, the metering needle 46 of the fuel metering valve 35 embodied as a needle valve can be produced as follows: a wire 88 having a diameter of about 1 mm acting as raw material and in particular having a round cross section is wound in the manner of a spring on a rotatable mandrel acting as a carrier body 87, with adjacent courses contacting one another, and secured in place by screws 95 at its ends, then a predetermined contour is imparted to the circumference of the wire coil 88 which has thus been wound on the mandrel 87, the contour being provided by means of grinding with a grinding machine. The mandrel 87 is mounted between pivot points 96 for eccentric positioning relative to a grinding machine. The metering region 89 is then located in this ground-down contour. It is not necessary that the contour become steadily smaller toward the tip of the metering needle; instead, it may also have non-uniform areas. In the illustrated exemplary embodiment, the outer contour of the wire coil 88 has been ground down in the same manner at two different areas 89, so that after separation at points 90 and 91 by use of a saw means or any other suitable cutter means, two similar valve needles 46 are formed from each course of the coil. As shown in FIG. 6, the round wire is ground down from its outer diameter toward the mandrel so that the thinnest most point is at the point 90 with the thickness of the wire gradually increasing toward the points 89. Thus, the point 90 will be at the thinnest most point. It can be efficient, in a known manner, to remove the spine created by grinding at the outer contour of each valve needle in the metering region 89. It can likewise be advantageous to have the wire, which acts as raw material, undergo a heat treatment at about 400° C. for approximately 30 minutes before winding on the mandrel and to subject the individual valve needles 46 to a heat treatment at about 670° C. for approximately 15 minutes after the separation of the courses of the coil, in a known and suitable manner.

The grinding of the circumferential contour of the coil 88 on the mandrel 87 may be accomplished in a known manner on a known cam-grinding machine, or in a manner known per se the carrier body 87 being clamped eccentrically in a grinding machine, so that the grinding disc of the grinding machine removes material from the coil only in the metering areas 89. The metering area is ground down from the original 1 mm to a thickness approximately 0.25 mm in the thinnest area.

The method according to the invention for producing curved valve needles offers the advantage that in a simple and inexpensive manner a large number of valve needles can be produced at once which are indentical in dimension and fully interchangeable. Thus in a coil having one hundred courses, for instance, two hundred valve needles can be produced at once.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A method for producing a curved valve needle which comprises:

winding a spring-like wire of uniform contour around a mandrel to form a coil of separate side-by-side windings and securing each end of the coil to said mandrel.

grinding down said spring-like coil lengthwise of said mandrel such that the contour of each winding is similarly ground down along its circumference from a thinnest point in each direction to its normal uniform contour, and cutting each winding at its thinnest ground down point and at a point 180° therefrom to provide two similar curved valve needles.

2. A method as defined by claim 1, characterized in that said wire is subjected in a suitable manner to a heat treatment before grinding and the resultant valve needles are subjected in a suitable manner to a heat treatment after separation of the courses of the coil.

3. A method as defined by claim 1, characterized in that said wire has a circular cross section.

4. A method as defined in claim 2, wherein said wire is heat treated at a temperature of about 400° C. for about 30 minutes prior to winding on said mandrel.

5. A method as defined in claim 4, wherein said wire is heat treated at a temperature of about 670° C., for about 15 minutes subsequent to being cut into two similar valve needles.

6. A method as defined in claim 3, wherein said wire has a diameter of about 1 mm prior to grinding.

7. A method as defined in claim 4, wherein said wire has a diameter after grinding which is about 1 mm at one end and a thickness of about 0.25 mm at its ground end thinnest point.

* * * * *